US007516729B2

(12) United States Patent
Bedford

(10) Patent No.: US 7,516,729 B2
(45) Date of Patent: Apr. 14, 2009

(54) PROVIDING LUBRICANT TO AN ENGINE

(75) Inventor: Denis William Bedford, Cambridgeshire (GB)

(73) Assignee: J.C. Bamford Excavation Limited, Uttoxeter, Staffordshire (GB)

( * ) Notice: Subject to any disclaimer, the term of this patent is extended or adjusted under 35 U.S.C. 154(b) by 52 days.

(21) Appl. No.: 11/491,614

(22) Filed: Jul. 24, 2006

(65) Prior Publication Data

US 2007/0039782 A1 Feb. 22, 2007

(30) Foreign Application Priority Data

Jul. 28, 2005 (GB) ..... 0515494.3

(51) Int. Cl.
*F01M 1/04* (2006.01)

(52) U.S. Cl. ..... 123/196 R

(58) Field of Classification Search ..... 123/196 R, 123/196 CP, 196 M, 196 S; 417/286
See application file for complete search history.

(56) References Cited

U.S. PATENT DOCUMENTS

| | | | | | |
|---|---|---|---|---|---|
| 2,373,360 | A | * | 4/1945 | Walsh | 184/6.13 |
| 2,913,069 | A | * | 11/1959 | Heribert | 184/6.2 |
| 3,590,953 | A | | 7/1971 | Wellauer | |
| 3,716,308 | A | * | 2/1973 | Kobald | 417/286 |
| 3,800,913 | A | * | 4/1974 | Schmitt | 184/6.13 |
| 3,882,678 | A | * | 5/1975 | Fassbender | 60/405 |
| 4,002,027 | A | * | 1/1977 | Eley et al. | 60/430 |
| 4,023,548 | A | * | 5/1977 | Prasch | 123/196 |
| 4,116,577 | A | * | 9/1978 | Lauck | 417/286 |
| 4,237,993 | A | * | 12/1980 | Jablonsky | 180/406 |
| 4,306,840 | A | * | 12/1981 | Fassbender | 417/286 |
| 5,918,573 | A | | 7/1999 | Killion | 123/192.2 |
| 5,997,372 | A | | 12/1999 | Idzikowski et al. | |
| 6,129,158 | A | * | 10/2000 | Yamamoto et al. | 172/812 |
| 6,131,687 | A | * | 10/2000 | Leidinger et al. | 180/403 |
| 6,234,125 | B1 | * | 5/2001 | Neubauer et al. | 123/90.17 |
| 6,386,836 | B1 | | 5/2002 | Johnson | 417/310 |
| 6,739,305 | B2 | * | 5/2004 | Takahara et al. | 123/196 R |
| 6,837,209 | B2 | * | 1/2005 | Hori et al. | 123/196 R |
| 7,076,947 | B2 | * | 7/2006 | Ariga et al. | 60/452 |
| 7,086,366 | B1 | * | 8/2006 | Killion | 123/192.2 |

FOREIGN PATENT DOCUMENTS

| | | | |
|---|---|---|---|
| DE | 10034400 | A1 | 1/2002 |
| EP | 0664378 | | 7/1995 |
| EP | 1316683 | A2 | 6/2003 |
| EP | 1754868 | * | 2/2007 |
| GB | 2076059 | | 11/1981 |
| JP | 03237207 | | 10/1991 |
| WO | WO01/71168 | A1 | 9/2001 |

* cited by examiner

*Primary Examiner*—Hai H Huynh
(74) *Attorney, Agent, or Firm*—MacMillan, Sobanski & Todd, LLC

(57) ABSTRACT

A method and apparatus for providing lubricant to an engine which may be operated in either a normal position or an extreme angled position. Through gravity, the lubricant pools in a first location when the engine is in a normal position and pools in a second location when the engine is in an extreme position. A main pump provides fluid from a first location through a control valve to the engine when the engine is in a normal position. When the engine is in an extreme position, an auxiliary pump provides lubricant from the second location through the control valve to the engine. So long as the main pump has adequate lubricant pressure, lubricant is provided from the main pump to the engine.

17 Claims, 3 Drawing Sheets

PROVIDING LUBRICANT TO AN ENGINE

CROSS-REFERENCE TO RELATED APPLICATIONS

Priority is claimed to United Kingdom patent application Serial No. 0515494.3 filed Jul. 28, 2005.

STATEMENT REGARDING FEDERALLY SPONSORED RESEARCH OR DEVELOPMENT

Not Applicable.

TECHNICAL FIELD

This invention relates to a method of providing a supply of lubricant to working components of an internal combustion engine.

BACKGROUND OF THE INVENTION

Lubricant pumping apparatus typically draw lubricant into a pump inlet from a sump of the engine, and pump the lubricant under pressure to a plurality of galleries within the engine, from where the lubricant is distributed, to the working components to be lubricated. The lubricant then returns, usually under gravity, to the sump for further use.

In a working machine such as for example only, a skid steer type loading machine, which has a body mounting the engine, and a working arm e.g. for performing loading operations, in use the machine can adopt extreme attitudes, for example, an attitude which may be 45° to 50° or more to the horizontal. It will be appreciated that with an engine in such an extreme attitude, the lubricant may pool in the sump away from the pump inlet. This may cause the engine to be starved of essential lubrication, which may at least lead to premature engine wear. Where the lubricant starvation is prolonged, this may result in the catastrophic failure of the engine.

BRIEF SUMMARY OF THE INVENTION

According to one embodiment of the invention, a method and apparatus are provided for supplying lubricant to working components of an engine. The engine includes a reservoir for lubricant to which the lubricant returns after use, under gravity, at least when the engine is in a normal operating orientation. The method utilizes a pumping apparatus including a pump housing having main and auxiliary pumping chambers. A main pumping device which together with the main pumping chamber provides a main pump, and an auxiliary pumping device which together with the auxiliary pumping chamber provides an auxiliary pump. The main and auxiliary pumps are driven simultaneously. A main inlet extending from a regular location in the lubricant reservoir to the main pumping chamber and an auxiliary inlet extends from an alternative location to which lubricant may pass in the event that the engine is at an extreme attitude, to the auxiliary pumping chamber. A control valve is provided with a valve member. The valve member is moved between a first position in which lubricant pumped from the regular location by the main pump is delivered to a pumping apparatus outlet for supply to the working components of the engine when the engine is in a normal operating orientation, and a second position in which lubricant pumped from the alternative location by the auxiliary pump is delivered to the pumping apparatus outlet when the engine is at an extreme attitude.

The invention has particular but not exclusive application to providing a supply of lubricant to an internal combustion engine for e.g. a working machine such as a skid steer type loading machine. However the invention has applicability to other kinds of working machines, such as excavating machines.

The working machine may have a working arm provided at a front end of the working machine. The lubricant pumping apparatus can be located in a position such that in the event that the machine adopts an extreme attitude when the front end of the machine is below a rear end of the machine beyond a threshold amount wherein the lubricant flows out of the sump into the pump housing, the auxiliary pump delivers lubricant to the working components of the engine.

DETAILED DESCRIPTION OF THE INVENTION

Figure 1:
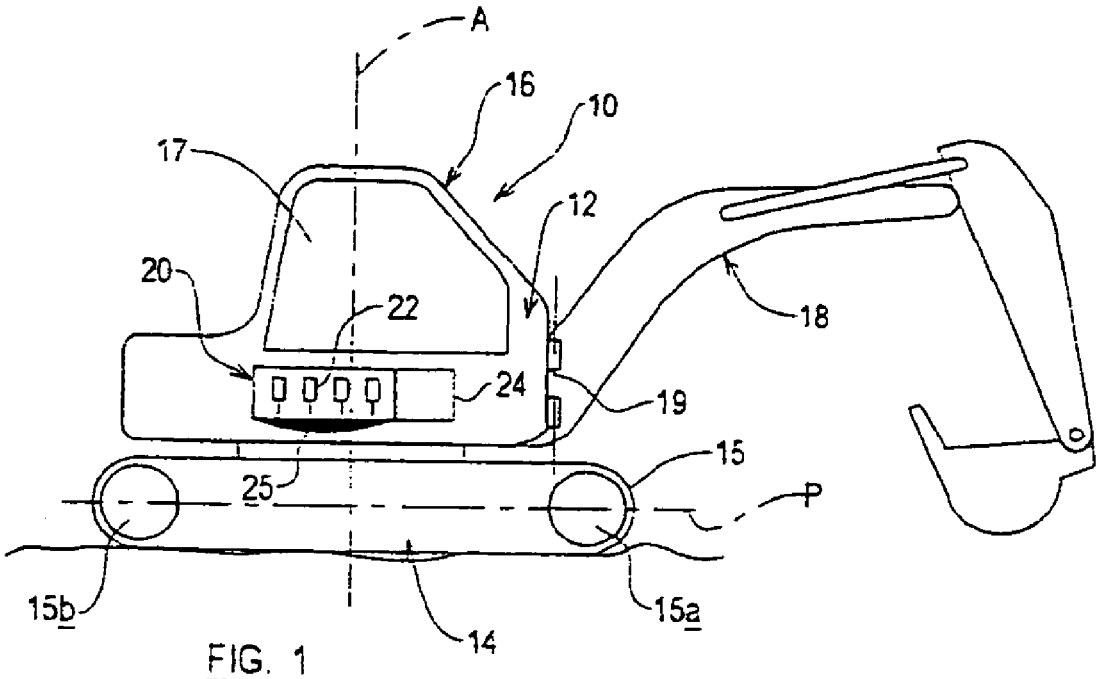
FIG. 1 is an illustrative side view of a working machine for which the present invention may be employed.

Referring to FIG. 1, a working machine 10 which is for excavating in this example, is illustrated. The machine 10 includes a body 12 with a ground engaging sub-structure 14 providing in this example, a pair of tracks 15 which are mechanically or hydrostatically driven via drive wheels 15*a*, 15*b*, and an upper body superstructure 16 which is rotatable relative to the sub-structure 14 about a usually generally upright axis indicated at A.

The superstructure 16 carries an operator's cab 17, and an excavating arm 18. The arm 18 is pivoted at a front end 19 of the upper body superstructure 16. The excavating arm 18 is of conventional construction and further more detailed description is not required. The upper body superstructure 16 further mounts an an internal combustion engine 20 which includes working components such as pistons 22 and other components too, which in use, require a supply of lubricant, such as oil. An oil pumping assembly 24 includes a pump housing 34 which may be either integral with or connected to an engine housing 21, as will be described below.

In normal use, by which we mean that the machine 10 is in the orientation shown in FIG. 1, or at least has an attitude of less than about 35° to the horizontal in this example, (that is a reference plane P which passes through the centers of drive wheels 15*a*, 15*b*, is less than 35° to the horizontal), oil used in the engine 20, collects in a sump 25 of the engine housing 21. A pumping apparatus 24 (see FIG. 3) draws oil into a main oil inlet 26 in the sump 25, and delivers it to a pumping apparatus outlet 27 which delivers the oil at pressure to one or more galleries 28, 29 of the engine 20 from where the oil is distributed to the various pistons and other working components 22.

Figure 2:
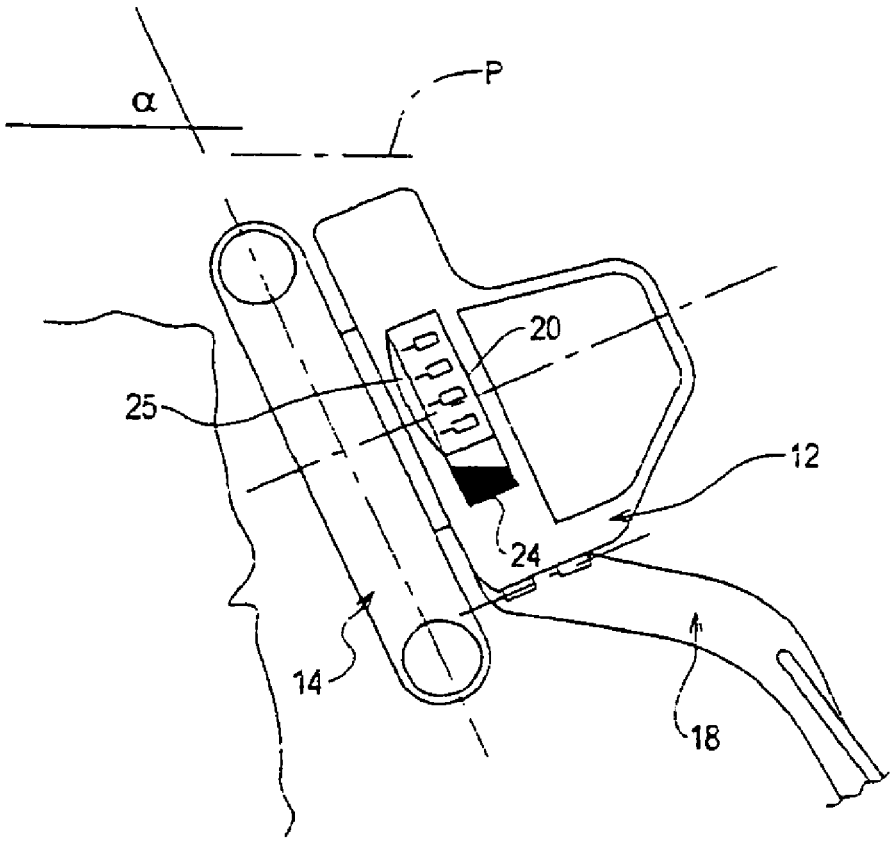
FIG. 2 is a view similar to FIG. 1 but showing the machine in an extreme attitude.

However, in the event that the machine 10 assumes an extreme attitude, as illustrated in FIG. 2, in which the orientation of the machine 10 is such that the plane P is at 35° or greater to the horizontal, the oil in the sump 25 tends to pool in locations separated from the main oil inlet 26. Typically, as in the example in the drawings, the oil may pass into the pump housing 34 of the fluid pumping apparatus 24. In the absence of any means to continue to provide an oil supply to the working components 22, it will be appreciated that starvation of lubricating oil available to the pumping apparatus 24, can damage the engine 20. Although obviously the machine 10 would not ordinarily be operated at the extreme attitude shown in FIG. 2, it is a requirement for the machine 10 to be able to be continue to be so operated, because a skilled machine operator may well be able to rescue the machine 10 from this extreme attitude, using the tracks 15 and the excavating arm 18 for example.

In accordance with the present invention, a lubricant supply is established by the oil pumping apparatus 24 which includes a main pump 30 which normally draws oil from a regular location in the sump 25 via the main inlet 26, and delivers it to the pumping apparatus outlet 27, and additionally an auxiliary pump 32 which may draw oil from an alternative location, into an auxiliary inlet 33, which is positioned where the oil may flow to, when the machine 10 assumes the extreme attitude shown in FIG. 2 and delivers it to the pumping apparatus outlet 27. In this case, the auxiliary inlet 33 is positioned at an alternative location in the pump housing 34 so that the auxiliary pump 32 may draw the oil from the alternative location of the oil pumping assembly housing 34, and deliver it to the pumping apparatus outlet 27.

It will be appreciated that in the event that a supply of oil to a pump is unavailable, it is undesirable for either the main pump 30 or the auxiliary pump 32 to deliver air to the pumping apparatus outlet 27, as this could seriously effect the efficiency of lubrication. Accordingly it is desirable in normal operation, for the auxiliary pump 32 to be isolated from the pumping apparatus outlet 27, and when the auxiliary pump 32 is operating to deliver the oil to the pumping apparatus outlet 27, for the main pump 30 to be isolated from the pumping apparatus outlet 27. A control valve 40 provides this functionality. In any event, both the main pump 30 and the auxiliary pump 32 are simultaneously driven and are thus both immediately available to deliver oil to the pumping apparatus outlet 27, depending upon availability of oil in the sump 25 in the case of the main pump 30, or in the pump housing 34 in the case of the auxiliary pump 32, and the condition of the control valve 40.

Figure 4:
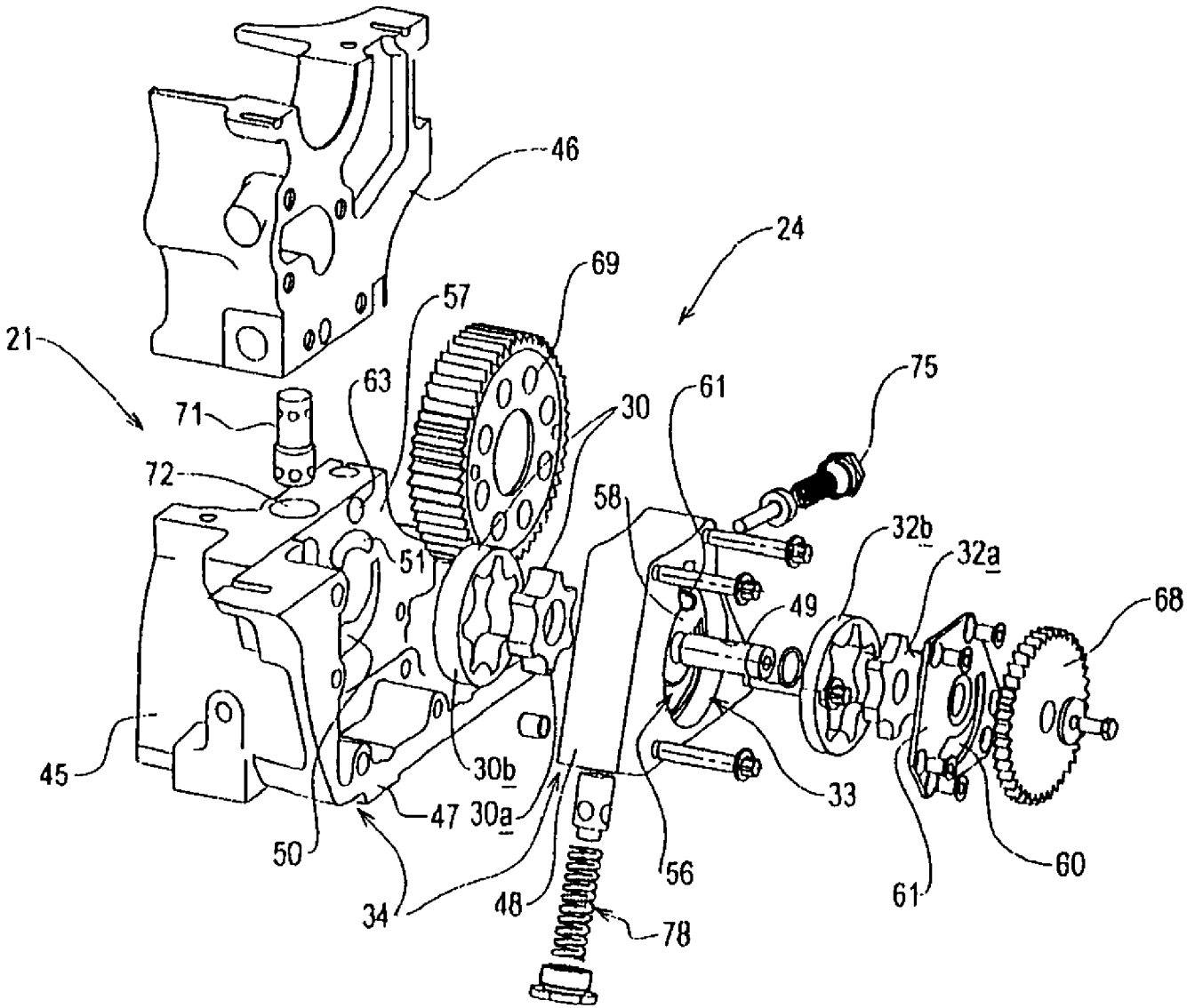
FIG. 4 is an exploded perspective view of an embodiment of the invention.

Referring now also to FIG. 4, more details will become apparent. The sump 25 is in this example provided by a bed plate 45 of the engine housing 21. The engine housing 21 includes an engine block 46 and a head (not shown). The pump housing 34 of the oil pumping apparatus 24 in this example, includes a gear case 47, and a pump body 48. The engine housing 21 and the pump housing 34 are in this example connected to each other but in an other example, could be integral.

The main pump 30 is illustrated as a gerotor type pump, includes nested hypocycloid inner and outer gear elements 30*a*, 30*b*. The inner gear element 30*a* is carried on a driven shaft 49 which extends through the pump body 48. The inner gear element 30*a* drives the outer gear element 30*b*. The inner and outer gear elements 30*a*, 30*b* of the main pumping device 30 are received within a main pumping chamber of the pump body 48. An inlet port 50 is provided by either one of the pump housing 34, a port plate, or as shown, an end wall 57 of the bed plate 45. The inlet port 50 is connected to the main pump inlet 26 to provide for oil to enter spaces between the meshing inner and outer gear elements 30*a*, 30*b*.

Since the outer gear element 30*b* has one more tooth than the inner gear element 30*a*, one tooth volume is swept each rotation of the pumping device. As the inner and outer gear elements 30*a*, 30*b* relatively rotate, spaces between the teeth on an inlet port 50 side increase, to draw oil into the spaces between the gear elements 30*a*, 30*b* through the inlet port 50. Simultaneously, at an opposite position, the spaces between the teeth of the gear elements 30*a*, 30*b* decrease, thus forcing fluid out of an outlet port 51 which also is provided by one of either the oil pumping housing 34, a port plate, or as shown, an end wall 57 of the bed plate 45 of the engine housing 21. The outlet port 51 communicates with control valve 40 as will be explained.

The auxiliary pump 32 is in the example, also a gerotor pump. An inner gear element 32*a* is carried on the driven shaft 49, and the inner and outer gear elements 32*a*, 32*b* are received within an auxiliary pumping chamber 56 of the pump body 48. The chamber 56 at an opposite side of a separating wall 58 to the main chamber of the main pumping device 30*a*, 30*b*. An inlet port 60 for the auxiliary pump 32 is provided in a port plate 61 which closes the auxiliary pumping chamber 56 and provides a support for the drive shaft 49. The inlet port 60 communicates with the auxiliary pump inlet 33 which in this example, is located in the gear case 47. An outlet port 61 is provided in the separating wall 58 of the pump body 48, and communicates via a communicating passage 63 in the bed plate 45 end wall 57, with the control valve 40 as will be explained.

In another embodiment, other species of main and auxiliary pumps 30, 32 may be used, which may independently be driven rather than the pumping devices of each being carried on a common drive shaft 49. In the present example, the drive shaft 49 is mechanically driven via a driven gear 68 which is carried on the drive shaft 49, the driven gear 68 is driven by a drive gear 69 which may in turn be driven from an engine crank. In another embodiment, one or both of the main and auxiliary pumps 30, 32 may be driven electrically or hydraulically or by any desired motive means. In the illustrated embodiment, the drive 69, and driven 68 gears, as well as the gear elements 30*a*, 30*b* and 32*a*, 32*b* are accommodated within the gear case 47 of the pump housing 34. Examples of other suitable pumps are screw pumps, gear pumps, and impeller pumps.

The control valve 40 includes a valve member 71 and a valve chamber 72. The valve chamber 72 in this embodiment is provided in the bed plate 45 of the engine housing 21. The valve member 71 is movable axially within the chamber 72.

In normal use of the working machine 10, when oil is available at the regular location in the sump 25 for pumping by the main pump 30, pressurized oil pumped through the outlet port 51 of the main pump 30 to a main pump outlet 30*c*, ensures that the valve member 71 assumes a position in the valve chamber 72 so that the pressurized oil is delivered to the pumping apparatus outlet 27. The auxiliary pump 32 is isolated from the pumping apparatus outlet 27. An auxiliary relief device, namely a valve 75 is provided, so that any oil which may be pumped by the auxiliary pump 32, is mainly returned to the sump 25 via an auxiliary relief passage 76. Some such oil may pass to the main pump 30 via a passageway 77, for lubricating the main pump 30 in the event that a supply of oil is unavailable to the main pump 30, for example, when the machine 10 is in the extreme attitude shown in FIG. 2.

Figure 3:
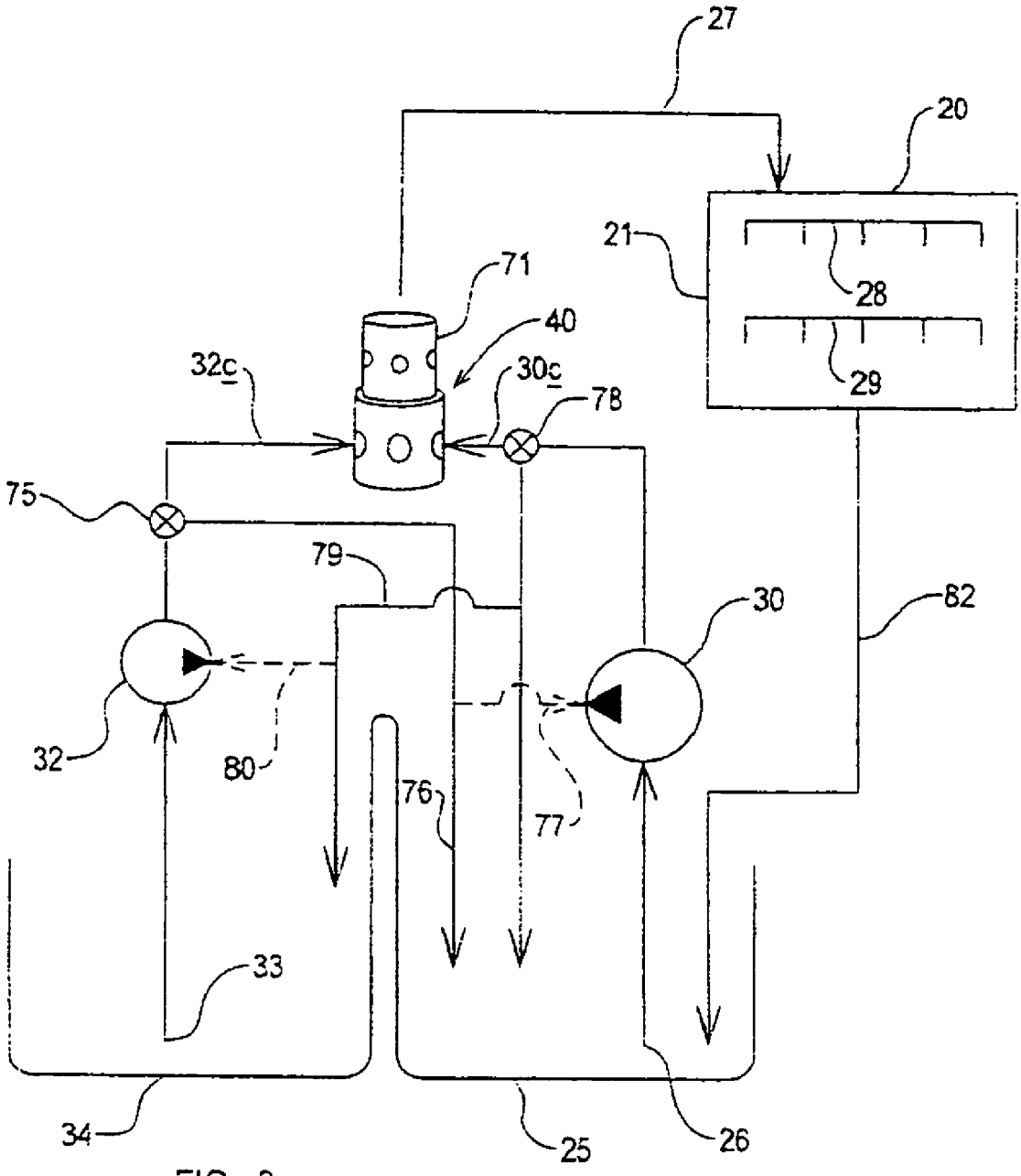
FIG. 3 is a diagrammatic illustration including a fluid pumping apparatus in accordance with the present invention.

A main relief device, i.e. a valve 78, is provided, for returning any excess oil pumped by the main pump 30, mainly to the sump 25. As can be seen in FIG. 3, some oil passes via a passageway 79 into the pump housing 34 to ensure that oil is always available to the auxiliary pump 32 so that it may immediately pump in the event that the oil supply for the main pump 30 becomes unavailable. Also, some of the excess oil passes via a passageway 80 to the auxiliary pump 32 to ensure lubrication of the auxiliary pump 32.

When the machine 10 assumes an extreme attitude, as described above, oil may pool in the pump housing 24, and is thus available at the alternative location for pumping by the auxiliary pump 32. Pressurized oil pumped through the outlet port of the auxiliary pump 32 to an auxiliary pump outlet 32*c*, acts to move the valve member 71 in its chamber 72, so that the pressurized oil from the auxiliary pump 32 is delivered to the pumping apparatus outlet 27, provided that there is not also an adequate supply of fluid being pumped by the main pump 30, in which case, the main pump 30 will take precedence. Any oil which has been delivered to the engine 20, after use, passes back into the sump 25 under gravity, as indicated by the line 82 in FIG. 3.

It can be seen from FIG. 4 that the radial dimensions of the pumping devices of the main and auxiliary pumps 30, 32 are about the same, but that axially, the gear elements 32*a*, 32*b* of the auxiliary pump 32 are thinner than the gear elements 30*a*, 30*b* of the main pump 30. The auxiliary pump 32 is thus of smaller capacity than the main pump 30, but being thinner axially, presents less parasitic drag as the gear elements 32*a*, 32*b* are rotated, although still is capable of delivering an adequate flow and pressure of lubricating oil when required to do so. This differential in pumping capacity also provides that that the main pump 30 will always take precedence over the auxiliary pump 32, so that in the event of oil being available both to the main 30 and auxiliary 32 pumps, the pumped oil from the main pump 30 will preferentially be directed to the pumped apparatus outlet 27, as the higher pressure produced by the main pump 30 will move the valve member 71 in its chamber 72 accordingly.

Various modifications additional to those already mentioned may be made without departing from the scope of the present invention.

For example, although the specific example described relates to an oil or other lubricant pump for an assembly which is an internal combustion engine 20 of a working machine 10, the invention may be applied for pumping other fluids in other assemblies as required.

The working machine 10 may be a loading machine, such as a skid steer type loading machine having a loading arm rather than an excavating arm 18, and the machine may have wheels instead of tracks 15.

It will be appreciated that various modifications and changes may be made to the above described preferred embodiment of without departing from the scope of the following claims.

The invention claimed:

1. A method of providing a supply of lubricant to working components of an engine, the engine including a reservoir for lubricant to which the lubricant returns after use, under gravity, at least when the engine is in a normal operating orientation, the method comprising the steps of providing a pumping apparatus, the pumping apparatus including a pump housing having main and auxiliary pumps and a control valve, the main pump including a main pumping chamber and a main pumping device, and the auxiliary pump including an auxiliary pumping chamber and an auxiliary pumping device, the main and auxiliary pumping devices being driven simultaneously by a common drive shaft, by the engine, and the pumping apparatus further including a main inlet extending from a regular location in the lubricant reservoir to the main pumping chamber and an auxiliary inlet which extends from an alternative location to which lubricant may pass in the event that the engine is at an extreme attitude, to the auxiliary pumping chamber, and the control valve including a valve member; and moving the valve member between a first position in which lubricant pumped from the regular location by the main pump is delivered to a pumping apparatus outlet for supply to the working components of the engine when the engine is in a normal operating orientation, and a second position in which lubricant pumped from the alternative location by the auxiliary pump is delivered to the pumping apparatus outlet when the engine is at an extreme attitude.

2. A method according to claim 1 wherein the control valve is provided with a valve chamber which communicates with a main pump outlet and an auxiliary pump outlet, the method including moving the valve member in the valve chamber towards its first position when a pressurized lubricant supply is delivered to the main pump outlet, and moving the valve member towards its second position when a pressurized lubricant supply is delivered to the auxiliary pumping apparatus outlet.

3. A method according to claim 2 which includes preferentially moving the valve member towards its first position, so that in the event that a lubricant supply is delivered by both the main and auxiliary pumps to their respective outlets, lubricant pumped by the main pump is delivered to the pumping apparatus outlet.

4. A method according to claim 3 wherein there is provided an auxiliary relief device and the method includes relieving any lubricant which is pumped by the auxiliary pump which is not required for use.

5. A method according to claim 1 wherein there is provided a main relief device and the method includes relieving excess pumped lubricant.

6. A method according to claim 1 wherein the main and auxiliary pumps are gerotor pumps, the pumping devices include inner and outer nested hypocycloid gear elements, the method including driving one of the gear elements to effect rotation of the other of the gear elements.

7. A method according to claim 6 wherein the auxiliary pump is of lesser axial extent than the main pump, whilst the radial dimensions of the main and auxiliary pumps are about the same, and the method including driving both the main and auxiliary pumping devices by a common drive shaft.

8. A method according to claim 1 which includes delivering at least some of the lubricant pumped by the main pump to a position to provide a supply of lubricant for lubricating the auxiliary pump.

9. In combination, an engine which includes working components which, in use, require a supply of lubricant, and a pumping apparatus, the engine including a reservoir for lubricant to which the lubricant returns after use, under gravity, at least when the engine is in a normal operating orientation, the pumping apparatus including a pump housing having main and auxiliary pumping chambers, a main pumping device which together with the main pumping chamber provides a main pump, and an auxiliary pumping device which together with the auxiliary pumping chamber provides an auxiliary pump, the main and auxiliary pumps being driven simultaneously, and the apparatus further including a main inlet extending from a regular location in the lubricant reservoir to the main pumping chamber and an auxiliary inlet which extends from an alternative location to which lubricant may pass in the event that the engine assumes an extreme attitude, to the auxiliary pumping chamber, and a control valve including a valve member which is moveable between a first position in which lubricant pumped from the regular location by the main pump is delivered to a pumping apparatus outlet for supply to the working components of the engine when the engine is in a normal operating orientation and a second position in which lubricant pumped from the alternative location by the auxiliary pump is delivered to the pumping apparatus outlet when the engine is at an extreme attitude.

10. A working machine having an engine which includes working components which, in use, require a supply of lubricant, and a pumping apparatus, the engine including a reservoir for lubricant to which the lubricant returns after use, under gravity, at least when the engine is in a normal operating orientation, the pumping apparatus including a pump housing having main and auxiliary pumping chambers, a main pumping device which together with the main pumping chamber provides a main pump, and an auxiliary pumping device which together with the auxiliary pumping chamber provides an auxiliary pump, the main and auxiliary pumps being driven simultaneously, and the apparatus further including a main inlet extending from a regular location in the lubricant reservoir to the main pumping chamber and an auxiliary inlet which extends from an alternative location to which lubricant may pass in the event that the engine assumes an extreme attitude, to the auxiliary pumping chamber, and a control valve including a valve member which is moveable between a first position in which lubricant pumped from the regular location by the main pump is delivered to a pumping apparatus outlet for supply to the working components of the engine, when the engine is in a normal operating orientation and a second position in which lubricant pumped from the alternative location by the auxiliary pump, is delivered to the pumping apparatus outlet when the engine is at an extreme attitude.

11. A machine according to claim 10 wherein the engine includes a housing including a sump which provides the reservoir for the lubricant, the pump housing being integral or connected to the engine housing, and the regular location from where the main pump draws lubricant, being in the sump, whilst the alternative location from where the auxiliary pump draws lubricant is in the pump housing.

12. A machine according to claim 11 wherein the working machine has a working arm provided at a front end of the working machine, the lubricant pumping apparatus is provided in a position such that in the event that the machine adopts an extreme attitude when the front end of the machine is below a rear end of the machine beyond a threshold amount, such that the lubricant flows out of the sump into the pump housing, the auxiliary pump delivers lubricant to lubricate the working components of the engine.

13. A method for circulating a supply of lubricant to working components of an engine, the lubricant flowing through gravity after use primarily to a first location when the engine is in a normal operating attitude, and flowing primarily to a second location when the engine is in a predetermined extreme attitude, comprising the steps of:

a) providing a main pump and an auxiliary pump, each pump having an inlet and an outlet;

b) connecting the main pump inlet to receive lubricant from the first location and connecting the auxiliary pump inlet to receive lubricant from the second location;

c) simultaneously driving said first and second pumps; and d) providing lubricant to the engine only from the main pump outlet so long as the main pump has a predetermined outlet flow or pressure, and providing lubricant to the engine only from the auxiliary pump outlet when the main pump does not have the predetermined outlet flow or pressure due to the orientation of the engine.

14. A method for circulating a supply of lubricant to working components of an engine according to claim 13, and further including the step of providing lubricant from the main pump outlet to the auxiliary pump while the main pump provides lubricant to the engine.

15. A method for circulating a supply of lubricant to working components of an engine according to claim 14, and further including the step of providing lubricant from the auxiliary pump outlet to the main pump while the auxiliary pump provides lubricant to the engine.

16. A method for circulating a supply of lubricant to working components of an engine according to claim 13, and further including the step of providing lubricant from the auxiliary pump outlet to the main pump while the auxiliary pump provides lubricant to the engine.

17. A method for circulating a supply of lubricant to working components of an engine according to claim 13, and further including the step of delivering any lubricant flow from the auxiliary pump outlet to the first location while the main pump provides lubricant to the engine.

* * * * *

UNITED STATES PATENT AND TRADEMARK OFFICE

CERTIFICATE OF CORRECTION

PATENT NO. : 7,516,729 B2
APPLICATION NO. : 11/491614
DATED : April 14, 2009
INVENTOR(S) : Denis William Bedford It is certified that error appears in the above-identified patent and that said Letters Patent is hereby corrected as shown below:

On the title page, item [73]: The assignee, "J.C. Bamford Excavation Limited" should read "J.C. Bamford Excavators Limited"

Signed and Sealed this

Twenty-ninth Day of September, 2009

David J. Kappos

David J. Kappos
*Director of the United States Patent and Trademark Office*